US008333617B2

(12) United States Patent
Fjelstad

(10) Patent No.: US 8,333,617 B2
(45) Date of Patent: Dec. 18, 2012

(54) CONNECTOR CONSTRUCTIONS FOR ELECTRONIC APPLICATIONS

(75) Inventor: Joseph C. Fjelstad, Maple Valley, WA (US)

(73) Assignee: Interconnect Portfolio LLC, Cupertino, CA (US)

( * ) Notice: Subject to any disclaimer, the term of this patent is extended or adjusted under 35 U.S.C. 154(b) by 0 days.

(21) Appl. No.: 13/473,249

(22) Filed: May 16, 2012

(65) Prior Publication Data

US 2012/0225590 A1 Sep. 6, 2012

Related U.S. Application Data

(62) Division of application No. 12/684,835, filed on Jan. 8, 2010, now Pat. No. 8,246,387.

(51) Int. Cl.
*H01R 24/00* (2011.01)

(52) U.S. Cl. ..... 439/660; 439/733.1

(58) Field of Classification Search ..... 439/660, 439/733.1, 637, 941
See application file for complete search history.

(56) References Cited

U.S. PATENT DOCUMENTS

| | | | | |
|---|---|---|---|---|
| 2,408,583 | A | 10/1946 | Sions | |
| 2,926,328 | A | 2/1960 | Flanagan | |
| 3,233,204 | A | 2/1966 | De Vore | |
| 3,333,226 | A | 7/1967 | Donnelly | |
| 3,786,401 | A | 1/1974 | Jones et al. | |
| 3,829,820 | A | 8/1974 | Hubner et al. | |
| 4,008,939 | A | 2/1977 | Kinkaid et al. | |
| 4,025,148 | A | 5/1977 | Bouley | |
| 4,105,277 | A | 8/1978 | Jacobs | |
| 4,735,588 | A | 4/1988 | Bird et al. | |
| 4,941,853 | A | 7/1990 | Harwath | |
| 5,273,455 | A | 12/1993 | MacLellan | |
| 5,749,752 | A * | 5/1998 | Kashiyama et al. | 439/733.1 |
| 5,772,474 | A | 6/1998 | Yagi et al. | |
| 6,217,341 | B1 | 4/2001 | Glick et al. | |
| 6,247,938 | B1 | 6/2001 | Rathburn | |
| 6,616,966 | B2 | 9/2003 | Mathieu et al. | |
| 6,719,567 | B2 | 4/2004 | Billman et al. | |
| 6,736,665 | B2 | 5/2004 | Zhou et al. | |
| 6,771,084 | B2 | 8/2004 | Di Stefano | |
| 6,945,827 | B2 | 9/2005 | Grube et al. | |
| 7,210,955 | B2 * | 5/2007 | Ringler et al. | 439/381 |
| 7,845,986 | B2 | 12/2010 | Yasumura et al. | |
| 7,909,615 | B1 | 3/2011 | Yasumura et al. | |
| 8,079,848 | B2 | 12/2011 | Yasumura et al. | |
| 8,079,879 | B2 * | 12/2011 | Chiang | 439/660 |
| 2001/0034163 | A1 * | 10/2001 | Chiang | 439/660 |
| 2002/0180473 | A1 | 12/2002 | Di Stefano | |
| 2005/0048849 | A1 * | 3/2005 | Wang et al. | 439/733.1 |
| 2008/0102712 | A1 * | 5/2008 | Giefers | 439/733.1 |
| 2011/0171857 | A1 | 7/2011 | Yasumura et al. | |

* cited by examiner

*Primary Examiner* — Tho D Ta
(74) *Attorney, Agent, or Firm* — Edward P. Heller, III

(57) ABSTRACT

An electronic wiping torsional connector for use in connecting to mating contacts on an insulating base. The connector includes a plurality of contacts 1-10 each having a contact 13 and an anchor 14. Contacts 1-10 twist against anchor 14 when the insulating base is inserted into the connector to provide the wiping contact. In an alternative embodiment, the conductors are wires having two bends at different angles. One bend is elongated such that it engages a paddle before the other and rotates the other bend into contact with a ribbon contact located on the paddle.

3 Claims, 9 Drawing Sheets

CONNECTOR CONSTRUCTIONS FOR ELECTRONIC APPLICATIONS

RELATED APPLICATIONS

The present application is a divisional application of U.S. patent Ser. No. 12/684, 835, filed 8 Jan. 2010, the entire contents of which are hereby incorporated by reference.

FIELD OF THE INVENTION

The present invention relates to the field of electric connectors, particularly the class of connectors which utilize wiping contacts. With still greater particularity, this application pertains to wiping contact paddle connectors including HDMI, iPod, USB, mini USB and methods to manufacture such connectors.

BACKGROUND OF THE INVENTION

Electric connectors have been used since the discovery of electricity. The original connector was a wire under a screw. That type of connector operates by compression, screw tension compresses the wire between a pair of contacts. A problem that has arisen with such connectors is that the contact becomes intermittent if the screw loosens or the contacts become soiled. Since the invention of the RCA connector, contacts are designed to be wiping contacts. A wiping contact scrapes across the surface of the mating contact upon insertion, cleaning both surfaces. Another variant of the wiping connector is that used in attaching printed circuit boards to a motherboard. In this type of connector one set of contacts are flat, ribbon-like metal features on the edge of either one or both sides of the board (male connector). The board fits into a socket (female connector) which includes a plurality of spring wiping contacts positioned to connect to the ribbon-like contacts on the mating half. As is usual in electronic technology, over time technology becomes miniaturized. One typical example of such a connector is that used in a USB connector. A small insulating base (e.g., a board or other substrate) having contacts on one side surrounded by a metal shell connected to ground is the male connector. The female connector is surrounded by a mating metal shell and includes a small board or interior of the housing with a plurality of wiping contacts which engage ribbon-like metal mating contacts on the small board. The contacts resemble fingers of wire which move in a direction normal to the surface of the board. A smaller version is called a mini USB connector. The pin number can be varied for similar connectors, e.g. the popular iPod® connects with a dock connector which includes a lock and additional contacts. Current generation Audio Visual equipment is connected with a HDMI connector having contacts on either side of the paddle and a mini HDMI connector includes two paddles which face each other inside the housing. Today, nearly all electronic equipment provides at least one connector. A problem has arisen with such connectors, particularly the mini's, they are difficult to manufacture economically while retaining the ability to connect after repeated insertions. Accordingly, there is a need for a connector which can be manufactured economically yet stand up to repeated use cycles.

SUMMARY OF THE INVENTION

The invention provides a connector which can be manufactured economically yet stand up to repeated use cycles. The invention includes ribbon-like, square or round wire contacts, for example, which twist upon insertion. The twisting forces the contacts into close contact with their mating contacts on an insulating base, for example, those mating contacts found on a paddleboard. One embodiment uses round contacts with two bends, the first bend is locked into position upon insertion of a paddleboard, the second bend is forced up or down rotating the contact. The natural elasticity of the contact material forces the contact into close engagement and electrical contact to any conducting material on the paddleboard. Another embodiment uses flat contacts having variable cross sections which are twisted into a final configuration. Alternative embodiments use different shaped contacts and connector configurations.

The method describes processes used to manufacture the connectors in large quantities and at minimal cost. One variant of the process manufactures the contacts as a suitable base material in roll to roll strip fashion which is cut into groups of connectors. Other variants manufacture contacts as a group attached to a substrate allowing batch processing.

DETAILED DESCRIPTION OF THE FIGURES

Figure 1:
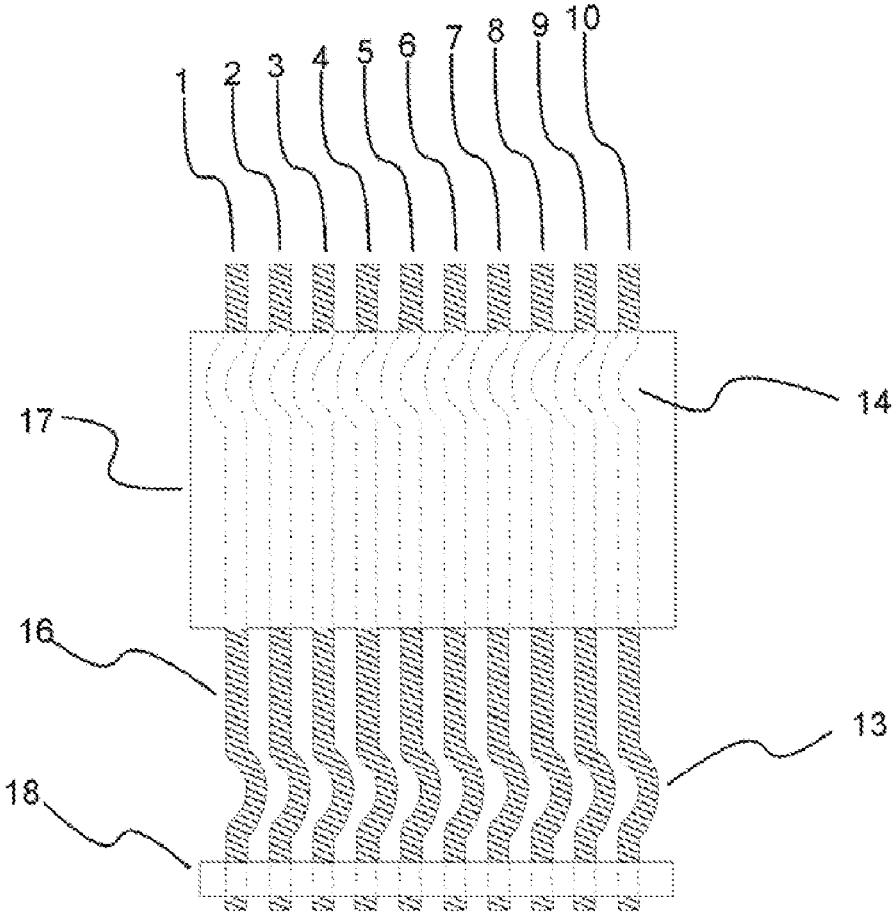
FIG. 1 is a plan view of a first embodiment of the invention.

FIG. 1 is a plan view of a first embodiment of the invention. The connector illustrated is a female micro HDMI connector, but it is appreciated that the invention is equally usable in any connector which makes contact to a paddleboard including but not limited to USB, iPod Dock, HDMI and similar connectors. The top contacts 1-10 in this embodiment are cylindrical metallic contacts. Each of contacts 1-10 includes a straight section 12 followed by a semicircular bend 14. Straight section 12 can be adapted for attachment to a printed circuit board or connection to a cable. A second semicircular bend 13 present on each of contacts 1-10 is at an angle to bend 14. A torsion section 16 is between bends 12 and 13. An anchor position 17 fixes the position of bend 14. Anchor position 17 is constructed of an insulating material such as epoxy polymer or an inorganic refractory material such as ceramic. A shell 18 fixes the separation between contacts 1-10 while allowing rotation. Bend 13 of each of contacts 1-10 forms the connection point of each of contacts 1-10.

Figure 2:
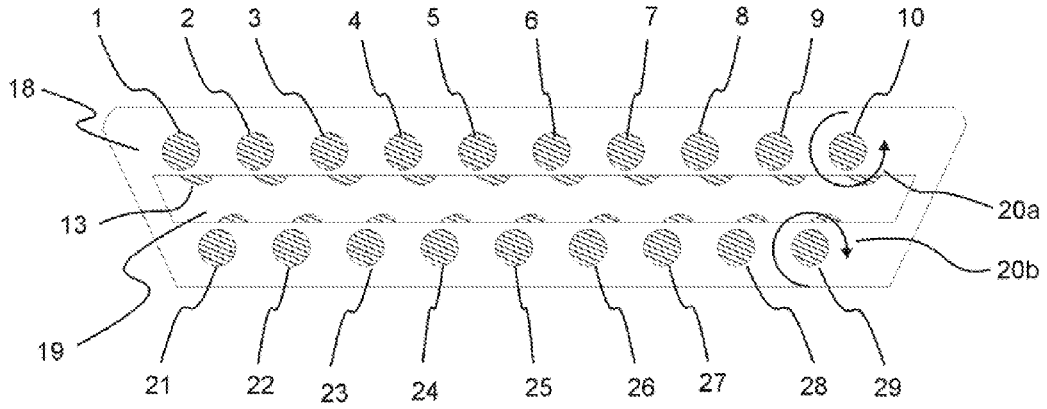
FIG. 2 is a front elevation view of the FIG. 1 embodiment.

FIG. 2 is a front elevation view of the FIG. 1 embodiment. Exemplary contact 1 is seen to be circular in cross section with bent section 13 offset to the side and down. Another set of contacts 21-29 is located beneath contacts 1-10. All contacts 1-10 and 21-29 are contained in shell 18. The formation leaves a slot 19 positioned to accept a paddleboard (not shown) the bent portions 13 extending into slot 19 in position for engagement with ribbons on the paddleboard. Upon insertion of the paddleboard, contact 10 twists counterclockwise as shown by arrow 20*a* and contact 29 twists clockwise as shown by arrow 20*b*.

Figure 3:
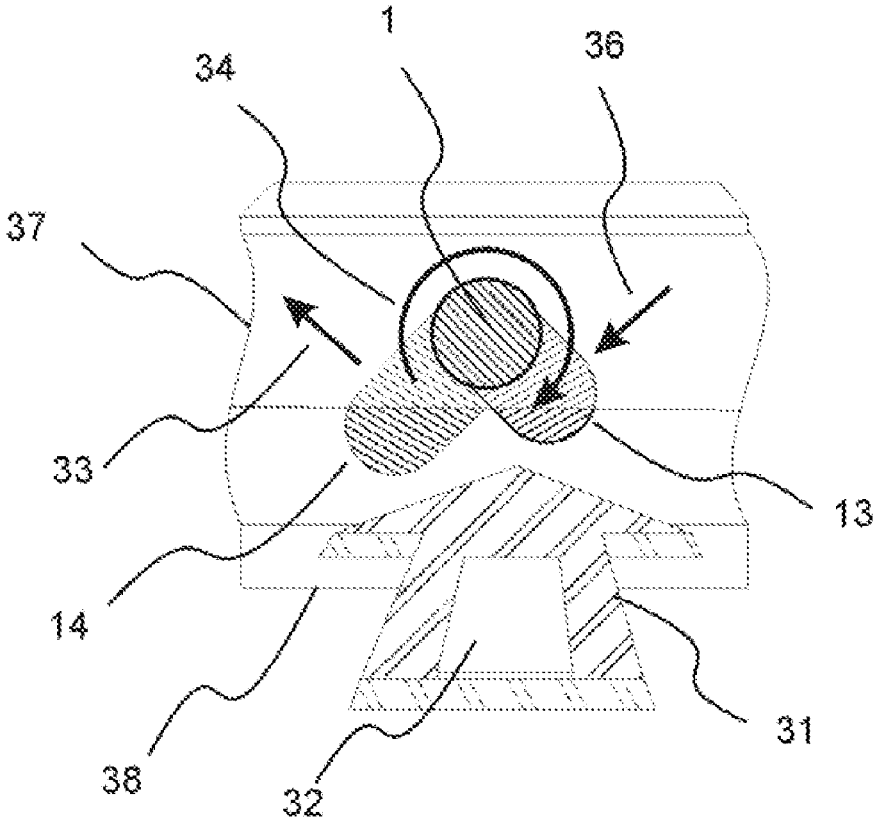
FIG. 3 is a schematic perspective view of one prospective alternative embodiment.

FIG. 3 is a schematic perspective view of one prospective alternative embodiment for operation of the FIG. 1 embodiment which would likely improve long-term contact reliability. While it is anticipated that the anchor features when encapsulated will resist the torsion, the anchor feature may serve to counter itself as illustrated. A single contact 1 is shown in FIG. 3 for clarity, although there are many contacts in an actual connector. Contact 1 is shown in support 37. Bent section 14 of contact 1 protrudes below support 37. When a paddle card 31 with a ribbon-like connector 32 is inserted below support 37, bent section 14 is moved in direction 33 twisting contact 1 in a clockwise direction 34. Bent section 14 is forced in direction 36 bringing bent section 13 into contact with ribbon-like connector 32 as illustrated. Thereafter, further rotation of 13 is resisted and the straight section 16 between bent sections 14 and 13 is put into tension ensuring a firm contact between ribbon-like metal contact 32 and bent section 13 of contact 1. A connection of this type would allow for zero insertion force (ZIF) as the twist is forced at the far end of contact 1, also causing a wipe to clean the contacts 13 and 32.

Figure 4:
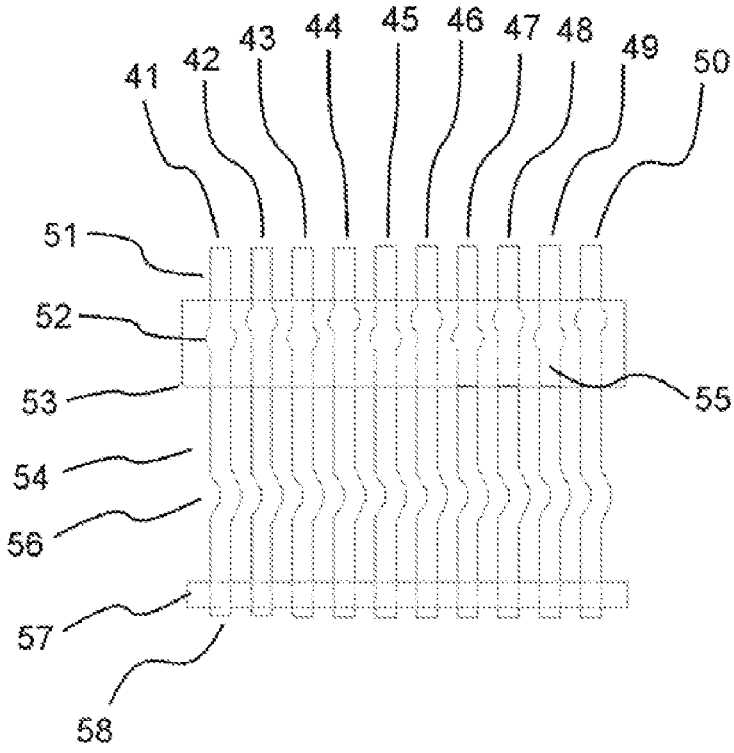
FIG. 4 is a plan view of a second embodiment of the invention.

FIG. 4 is a plan view of a second embodiment of the invention. There are several alternatives to round wires described above that may be more amenable to higher volume manufacturing. One is a lead frame embodiment as seen in FIG. 4. This allows all of the contacts 41-50 to be manufactured as a group and in proper position. The material of contacts 41-50 should be of a relatively high modulus material to provide resilience as a contact. Each of contacts 41-50 includes a connection area 51 for attachment to a PC board or cable. Each of contacts 41-50 further includes a torsion anchor area 52. Torsion anchor area 52 may be equipped with a hole 55 to further improve locking into location. Anchor area 52 is covered with an anchor 53 to prevent twisting. Each contact is equipped with a contact area 56 surrounded by a torsion area 54. While produced flat, contact area 56 is twisted in a later step to assure contact wipe and provide bias for the resilient contact. A second anchor (not shown) may fix the end 58 opposite the connection 51. Contacts 41-50 may be chemically or electrochemically polished before plating with finishing metal to remove sharp edges and provide a smoother operation.

Figure 5:
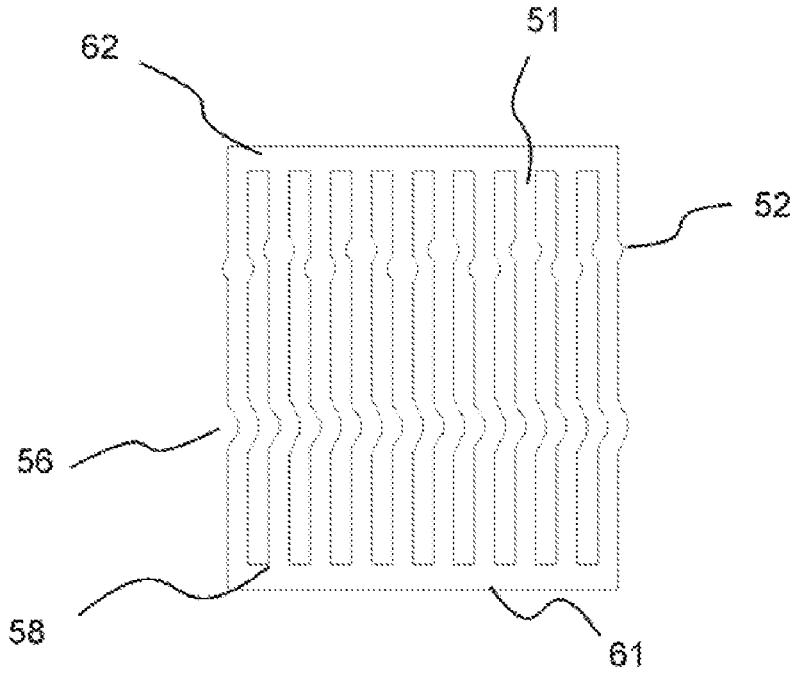
FIG. 5 illustrates the method of the invention.

FIG. 5 illustrates a method of the invention. All contacts are formed as a frame with the top ends 51 of the contacts joined to a top processing bus bar 62 and the distal ends 58 joined to a bottom processing bus bar 61. The frame may be formed continuously by punching a ribbon of metal material or by imaging a pattern on the metal ribbon and etching the exposed metal using a suitable etching chemistry. Bus bars 61 and 62 can serve to allow a low contact resistance metal (e.g., gold) to be spot plated to the contact areas and then said bus bars would be removed during later processing. Contact areas 56 are twisted to a suitable permanent angle set point during fabrication to provide a tensional contact. To provide lower insertion force, contact areas 56 may be staggered in the manner of anchors 52 to reduce insertion force.

Figure 6:
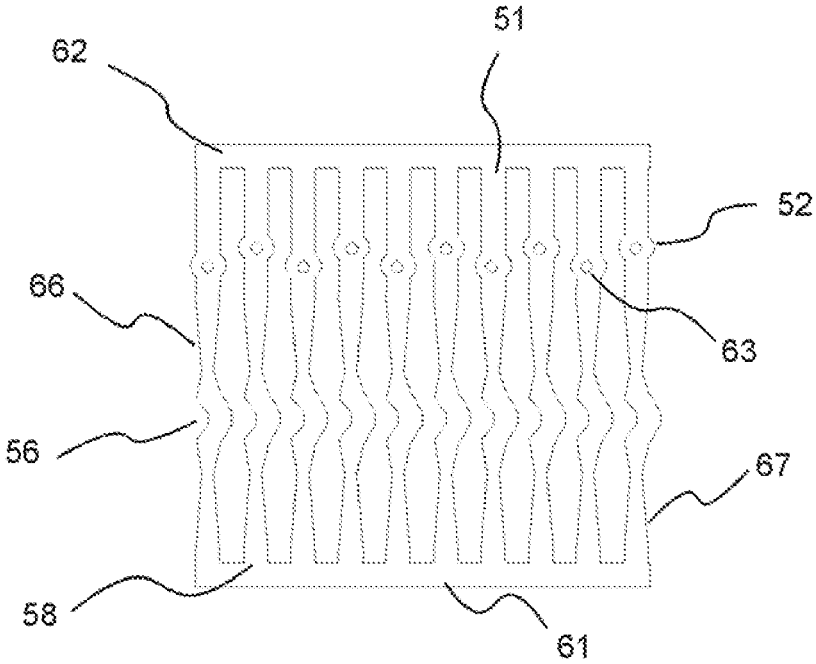
FIG. 6 is a plan view of a third embodiment of the invention.

FIG. 6 is a plan view of a third embodiment of the invention in construction. This embodiment of the lead frame structure includes the leads tapered at the top of the torsion area 66 and the bottom 67 in opposite directions leading to torsion contact area 56. The tapering of the leads will provide a prospective force gradient wherein the force increases as the contact gets twisted (providing the material remains in the elastic region). The taper may also allow for fine tuning the forces required. Torsion anchor area 52 may be equipped with a hole 55 to further improve locking into location as it will be filled with insulating material when a flowable encapsulation or molding material is used. This allows a lower force to be applied at initial contact to ease connector engagement. The contacts 56 may be desirably staggered slightly (not shown) so that the forces applied increase gradually over increasing numbers of contact engagements. Bus bars 61 and 62 are removed at a suitable point during the assembly process. Contact areas 56 are twisted to form a suitable permanent angle set point during fabrication, which provides a torsional contact in use.

Figure 7:
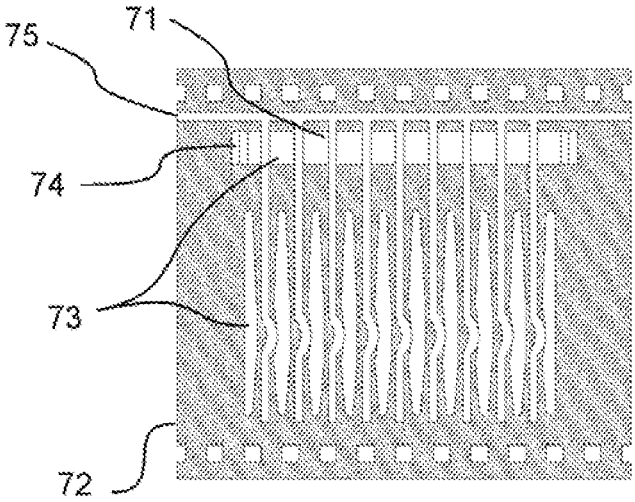
FIG. 7 illustrates a second embodiment of the method of the invention.

FIG. 7 illustrates a second embodiment of the method of the invention. This method for fabricating the contact sets is to manufacture contact strip elements 71 on thin base materials 72 (possibly of high strength to provide resilience). Because the material is thin, it is also typically flexible, allowing for processing to be accomplished in a roll-to-roll manner using processing technology used for the manufacture of tape automated bonding (TAB) circuits. Apertures 73 are provided to facilitate soldering while holding contact elements 71 in place accurately. Contacts may be provided on either side of base 72, as evidenced by contact 74 which is visible in upper aperture 73 which could prospectively be ground and/or power contacts as well as signals.

Figure 8:
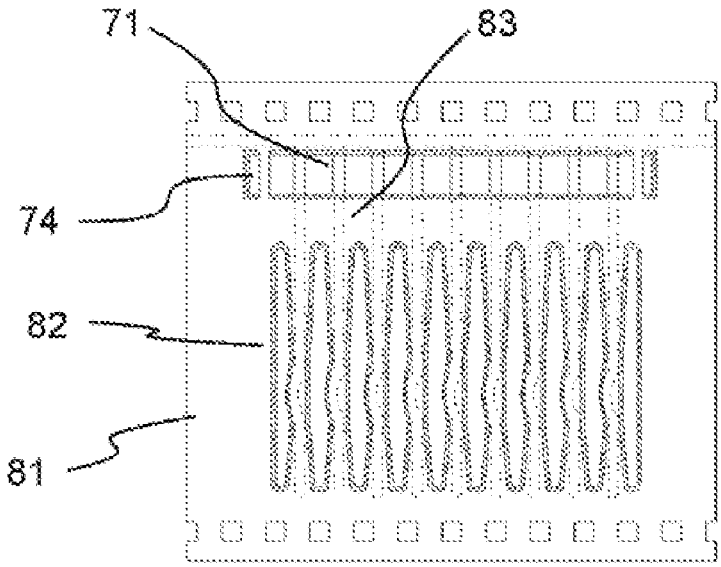
FIG. 8 illustrates a third embodiment of the method of the invention.

FIG. 8 illustrates a third embodiment of the method of the invention. The contact element structure 71 and 83 can be provided with a metal back 81. Metal back 81 serves both mechanical and electrical purposes. Metal back 81 if a high modulus metal provides contact resilience (springiness). Metal back 81 can also serve as an electrical ground to improve electrical performance, including control of characteristic impedance. This, when combined with a cable (not shown) also having controlled impedance allows for signal integrity to be maintained all the way from the cable to the connector.

Figure 9:
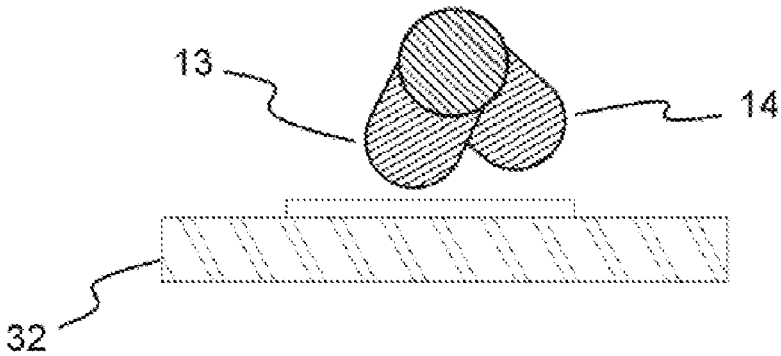
FIG. 9 is a schematic view of a fourth embodiment of the invention disengaged.

FIG. 9 is a schematic view of a fourth embodiment of the invention disengaged. In this embodiment, no fixed anchor is required; a redundant contact is produced without the need for a mechanical lock to effect torsion. While only contact 1 is shown, it should be appreciated that a connector will have many such contacts. Contact 1 is bent to produce two contact areas 13 and 14 which make contact to a contact strip 32 on a paddleboard 31 which is not yet engaged in this view. The counter rotating contact areas 13 and 14 act as an anchor.

Figure 10:
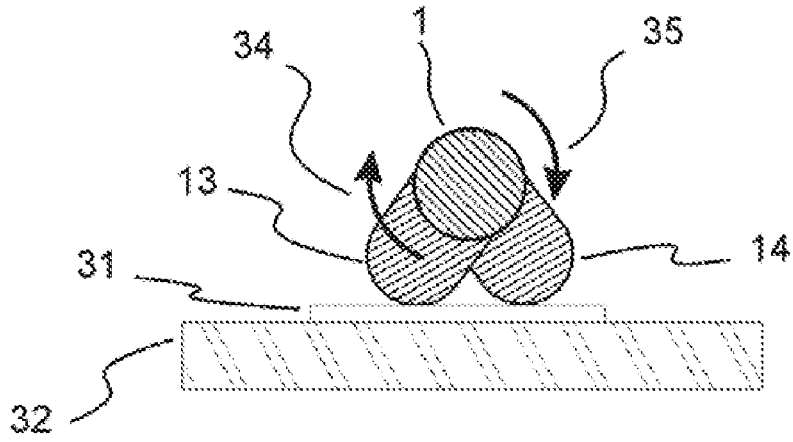
FIG. 10 is a schematic view of the FIG. 9 embodiment engaging.

FIG. 10 is a schematic view of the FIG. 9 embodiment engaging. When paddleboard 31 is inserted into a connector, contact area 13 is rotated clockwise, as shown by arrow 34, while contacting contact strip 32. The resulting torque rotates contact 14 clockwise as indicted by arrow 35 until it contacts contact strip 32 on paddleboard 31.

Figure 11:
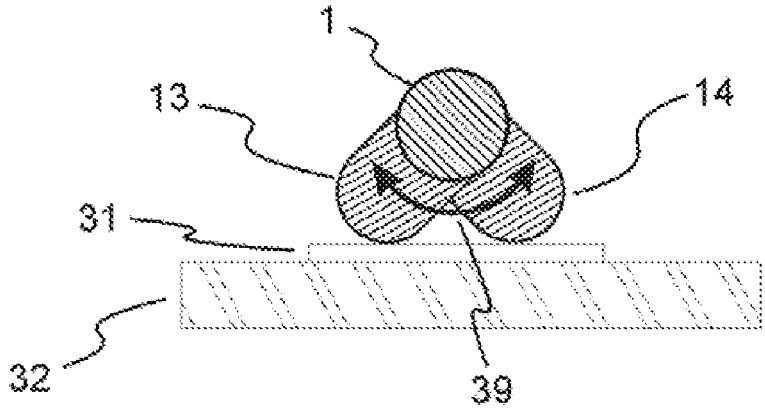
FIG. 11 is a schematic view of the FIG. 9 embodiment engaged.

FIG. 11 is a schematic view of the FIG. 9 embodiment engaged. When paddleboard 31 is fully engaged, contact 32 pushes contact area 13 clockwise and contact area 14 counterclockwise, twisting contact 1 as indicated by arrow 39. The two contact areas 13 and 14 produce redundant wiping torsion contacts.

Figure 12:
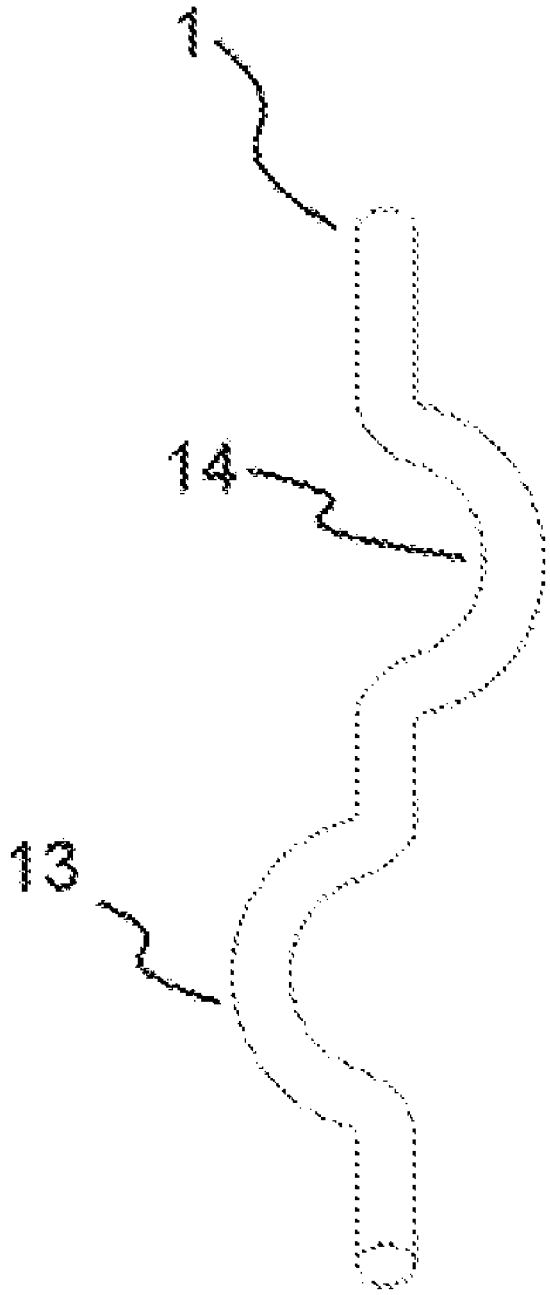
FIG. 12 is a top plan view of the FIG. 9 embodiment contact.

FIG. 12 is a top plan view of the FIG. 9 embodiment contact. Contact 1 includes two opposing torsion contact areas 13 and 14.

Figure 13:
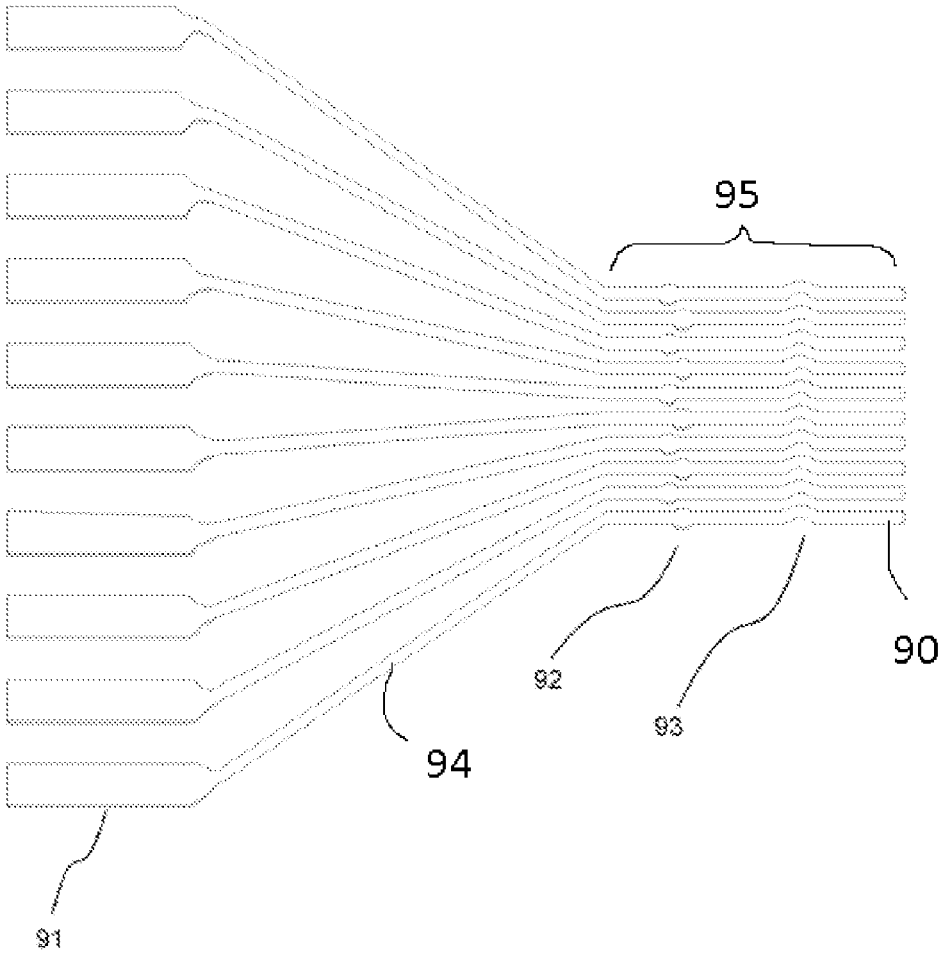
FIG. 13 is a top plan view of a fifth embodiment of the invention.

FIG. 13 is a top plan view of a fifth embodiment of the invention. In this embodiment, swaging is used to shape the distal ends of a long wire 90 and to clamp them with a housing (e.g., 17 of FIG. 1, 53 of FIG. 4) to make a reliable connector/connection with a contiguous channel. Each wire 90 comprises a elongated, straight structure 95 into which is swaged features that produce an anchor area 92 and a contact area 93, which contact areas, as illustrated, comprises in a preferred embodiment a semicircular bend or protrusion that, as described in connection with bend 13 in FIGS. 1, 3, and 9-12 (protrusion: FIGS. 5-7), is angled such as to permit wiping engagement with a contact such as to impart a twisting, i.e., a torsional force, not a bending force, to wire 90. A housing (not shown), but like housing 17 illustrated in FIG. 1 or housing 53 of FIG. 4, could be injection molded onto anchor area 92 to produce a connector of the type shown in FIG. 1 or in FIG. 4. Two of the FIG. 13 assemblies stacked (as illustrated in FIG. 2) can be used to produce an adapter for HDMI converting from size A female to size C and size D male. In this case, area 91 is flattened to produce the ribbon-like contact of the larger connector and the contact area 93 acts as the wiping contact for the smaller connector. As illustrated, the ribbon-like contacts are arrayed in a fan-like structure where the flattened contacts 91 have surface arranged in substantially the same plane, and where the ribbon-like contacts are connected to member 94 that each have an angle to a imaginary center that increases from zero as the distances from the imaginary center increases. As illustrated, the wires 90 converge from the ribbon-like structures 91 to an area consisting of a plurality of substantially, elongated, straight, parallel members 95, wires in the preferred embodiment, arranged in a plane. As described in connection with wiping contact 13 of FIGS. 1, 3, and 9-12 (see also, the description of FIG. 5, where the protrusion 56 is twisted), a plane drawn through the semicircular contact 93 and through the length of the elongated, straight, section of a wire forms an angled with respect to the plane formed by the elongated straight structures 95. As illustrated in the aforementioned figures, when this semicircular contact 93 encounters the contact of a mating contact (e.g., 32, FIGS. 3; and 31, FIGS. 10, and 11), a rotational twisting force is imparted to the wiping contact 93 to impart a torsional force in wire 90. There are interesting possibilities for creating male to male or female to female (genders are somewhat fungible as they have differing external and internal genders). One example of something of possible interest would be an adaptive connector that can accept a cable with a male blade of one pitch at one end and male blade of another pitch at the other end. Various modifications may be made to the invention without altering its value or scope. For example, while this invention has been described herein using the example of the particular Micro HDMI connector, many or all of the inventive aspects are readily adaptable to other connectors, including USB, iPod dock, motherboard sockets, and any connector using wiping contacts for boards with ribbons, and the like.

While specific examples of the inventive contacts 1-10, 21-28, and 41-50 contact areas 13 and 56 torsion areas 16, 54, 66 and 67, anchor areas 42 and associated apparatus, and the construction methods as illustrated in FIGS. 5-8 have been discussed herein, it is expected that there will be a great many applications for these which have not yet been envisioned. Indeed, it is one of the advantages of the present invention that the inventive methods and apparatus may be adapted to a great variety of uses, including high reliability automotive, aerospace and military products.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

Industrial Applicability

The inventive contacts 1-10, 21-28, and 41-50 contact areas 13 and 56 torsion areas 16, 54, 66 and 67, anchor areas 42 and associated apparatus, and the construction methods as illustrated in FIGS. 5-8 are intended to be widely used in a great variety of electronic, audio/visual and communication applications. It is expected that they will be particularly useful in digital audio/visual where accurate connections and low cost implementations are required.

As discussed previously herein, the applicability of the present invention is such that electrical contact greatly enhances the inputting of data and instructions, both in speed and bandwidth. Also, communications between an audio/video device and other devices are enhanced according to the described method and means. Since the inventive contacts 1-10, 21-28, and 41-50, contact areas 13 and 56, torsion areas 16, 54, 66 and 67, anchor areas 42 and associated apparatus, and the construction methods as illustrated in FIGS. 5-8 may be readily produced and integrated with existing tasks, input/output devices and the like, and since the advantages as described herein are provided, it is expected that they will be readily accepted in high reliability automotive, aerospace and military products. For these and other reasons, it is expected that the utility and industrial applicability of the invention will be both significant in scope and long-lasting in duration.

I claim:

1. A connector, comprising:

a plurality of substantially straight conductors, arranged substantially parallel to each other in a plane; each conductor having:

a pair of intermediate protrusions:

an engagement protrusion projecting from the plane at a first angle; and a contact protrusion projection from the plane at a second angle;

wherein the angle of the engagement protrusion and the contact protrusion impart opposite torsional forces to the conductor in response to a force on each protrusion from the same direction toward the plane of the straight conductors.

2. The connector of claim 1, wherein the engagement protrusion extends away from the plane a greater distance than the contact protrusion.

3. The connector of claim 1 wherein each conductor comprises a wire and each protrusion comprises a semicircular bend.

* * * * *